US006863119B2

(12) United States Patent
Sugito et al.

(10) Patent No.: US 6,863,119 B2
(45) Date of Patent: Mar. 8, 2005

(54) COOLING DEVICE BOILING AND CONDENSING REFRIGERANT

(75) Inventors: Hajime Sugito, Nagoya (JP); Hiroshi Tanaka, Toyoake (JP); Takahide Ohara, Okazaki (JP)

(73) Assignee: DENSO Corporation, Kariya (JP)

( * ) Notice: Subject to any disclaimer, the term of this patent is extended or adjusted under 35 U.S.C. 154(b) by 297 days.

(21) Appl. No.: 09/952,803

(22) Filed: Sep. 14, 2001

(65) Prior Publication Data

US 2002/0029873 A1 Mar. 14, 2002

(30) Foreign Application Priority Data

Sep. 14, 2000 (JP) ..... 2000-280490
Feb. 15, 2001 (JP) ..... 2001-037902

(51) Int. Cl.[7] ..... H05K 7/20

(52) U.S. Cl. ..... 165/104.33; 165/80.3; 165/80.4; 361/700; 257/715; 174/14.2

(58) Field of Search ..... 165/104.33, 80.4; 257/715; 361/700; 174/15.2

(56) References Cited

U.S. PATENT DOCUMENTS 5,529,115 A * 6/1996 Paterson ..... 165/104.33
5,924,481 A * 7/1999 Tajima ..... 165/104.33
5,998,863 A * 12/1999 Kobayashi et al. ..... 257/715
6,005,772 A * 12/1999 Terao et al. ..... 361/699
6,321,831 B1 * 11/2001 Tanaka et al. ..... 165/104.33
6,341,645 B1 * 1/2002 Tanaka et al. ..... 165/104.33

FOREIGN PATENT DOCUMENTS

JP A-10-308486 11/1998

* cited by examiner

*Primary Examiner*—Allen J. Flanigan
(74) *Attorney, Agent, or Firm*—Harness, Dickey & Pierce, PLC

(57) ABSTRACT

In a cooling device boiling and condensing refrigerant, a heat conductor portion for thermally connecting a heat reception wall and a heat radiation wall defining a closed container is disposed in the closed container, a heat-generating member is attached on the heat reception wall, and a heat radiation fin for radiating heat generated from the heat-generating member to an outside is provided on the heat radiation wall. In the cooling device, both ends of the tube are connected to the closed container at different position of the heat radiation wall to communicate with the closed container, so that the heat radiation fin is enclosed by the heat radiation wall and the tube.

42 Claims, 11 Drawing Sheets

COOLING DEVICE BOILING AND CONDENSING REFRIGERANT

CROSS-REFERENCE TO RELATED APPLICATION

This application is related to and claims priority from Japanese Patent Applications No. 2000-280490 filed on Sep. 14, 2000 and No. 2001-37902 filed on Feb. 15, 2001, the contents of which are hereby incorporated by reference.

BACKGROUND OF THE INVENTION

1. Field of the Invention

The present invention relates to a cooling device for cooling a heat-generating member such as a semiconductor element by boiling and condensing refrigerant.

2. Description of Related Art

In a conventional cooling device disclosed in JP-A-10-308486, a closed container, in which refrigerant is sealed, is constructed by a heat reception wall onto which a heat-generating member is attached, a heat radiation wall disposed opposite to the heat reception wall to have a clearance between the heat reception wall and the heat radiation wall, and a heat conductor portion disposed between the heat reception wall and the heat radiation wall for thermally connecting both the walls. Plate members having openings is laminated between the heat reception wall and the heat radiation wall, and plate thickness portions are provided between openings in each plate member. The plate thickness portions are connected to each other in a lamination direction of the plate members, so that the heat conductor portion is formed.

In this boiling cooler, however, because refrigerant circulates to be boiled and condensed in a flat space within the closed container through an arbitrary root, refrigerant cannot circulate smoothly, and satisfactory cooling performance cannot be obtained.

SUMMARY OF THE INVENTION

In view of the foregoing problem, it is an object of the present invention to provide a cooling device boiling and condensing refrigerant, which can improve cooling performance by circulating refrigerant smoothly therein.

According to the present invention, in a cooling device, a container for containing liquid refrigerant includes a heat reception wall onto which a heat-generating member is attached and a heat radiation wall opposite to the heat reception wall, a heat conductor portion for thermally connecting the heat reception wall and the heat radiation wall is provided in the container, and a heat radiation fin is disposed at an outside of the container to radiate heat generated from the heat-generating member to the outside through at least the heat reception wall, the heat conductor portion and the heat radiation wall. In the cooling device, a tube is disposed around the heat radiation fin to enclose the heat radiation fin with the heat radiation wall, and the tube has both end portions disposed to communicate with the container at both portions of the heat radiation wall. Accordingly, refrigerant flows from the container to the tube, and returns to the container. Therefore, refrigerant can circulate smoothly in a predetermined route in the cooling device, and cooling performance of the cooling device can be increased. Further, heat generated from the heat-generating member can be radiated from an outer wall surface of the tube in addition to the heat radiation wall and the heat radiation fin, and can be transmitted to the heat radiation fin from both sides of the tube and the heat radiation wall. Therefore, fin efficiency can be improved to totally improve cooling performance in the cooling device.

Preferably, the heat radiation fin is disposed to be inserted in a space defined at least by the tube and the heat radiation wall. Therefore, heat generated from the heat-generating member can be readily transmitted to heat radiation fin, and is readily discharged to the outside.

More preferably, the tube having therein a passage through which refrigerant from the container flows in a refrigerant flow direction is formed into a substantially U-shape along in the refrigerant flow direction in the tube. Therefore, the tube can be readily formed, and can be readily connected to the container.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

(First Embodiment)

Figure 1:
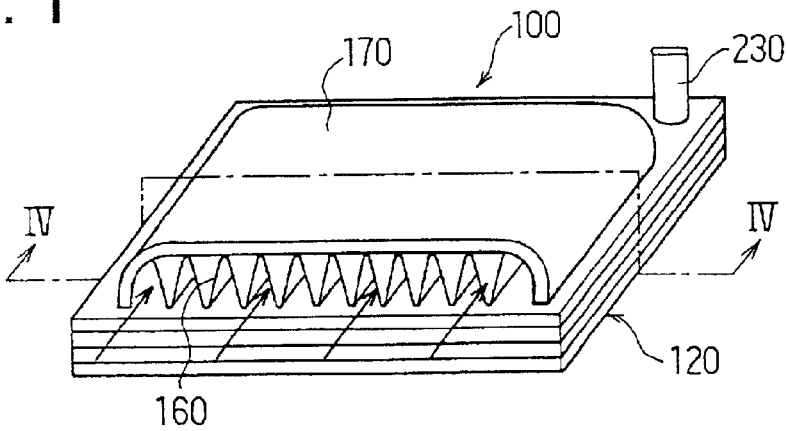
FIG. 1 is a schematic perspective view showing a cooling device according to a first preferred embodiment of the present invention.
Figure 2:
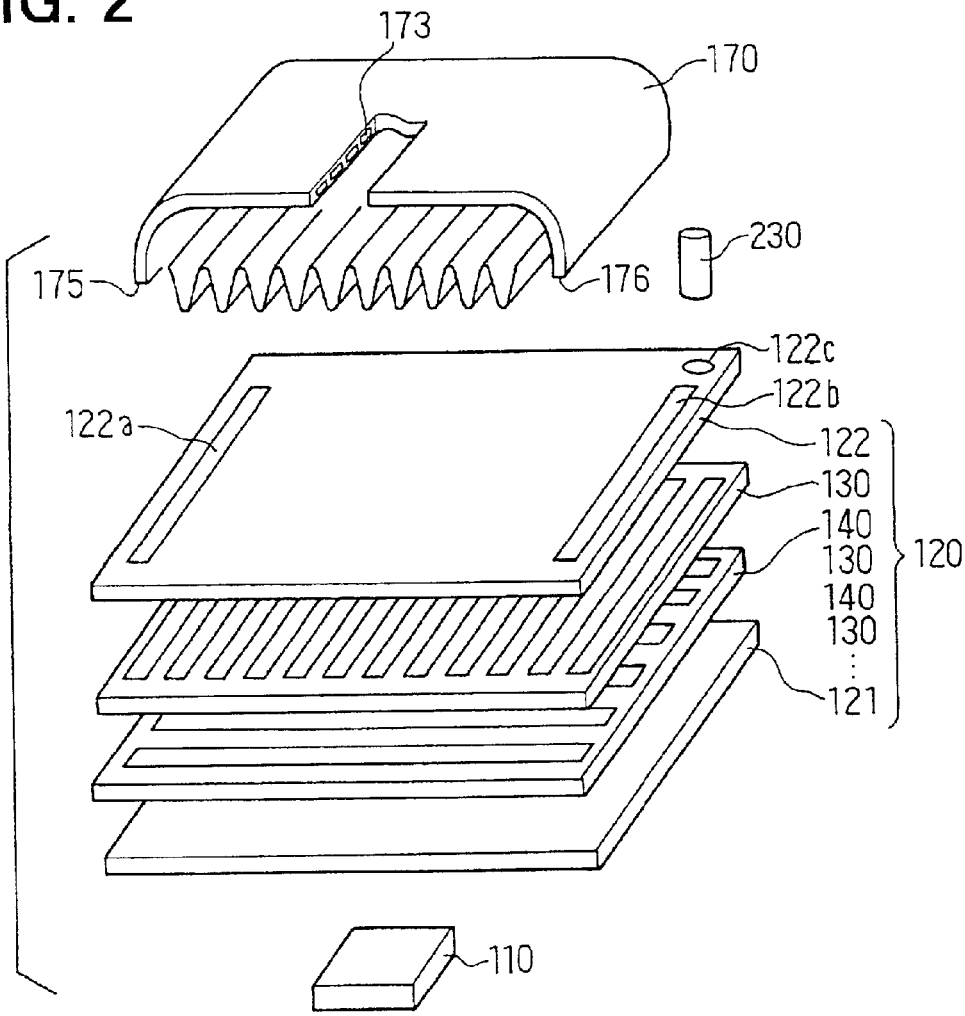
FIG. 2 is a disassembled perspective view showing the cooling device according to the first embodiment.

As shown in FIGS. 1 and 2, a cooling device 100, for cooling a heat-generating member 110 such as a semiconductor element, includes a closed container 120, a heat radiation fin 160, a tube 170 and the like.

Figure 3A:
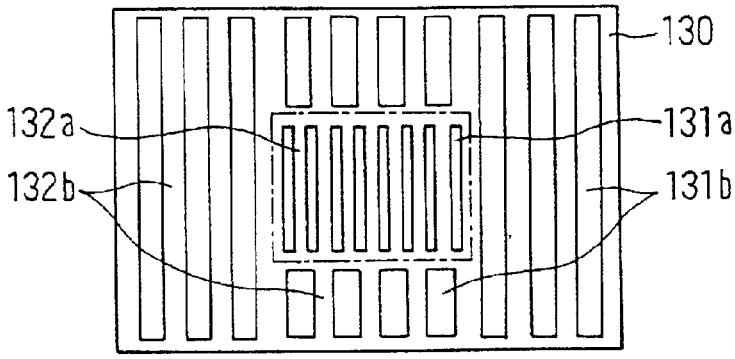
FIG. 3A is a plan view showing a plate member having openings extending in a vertical direction.
Figure 3B:
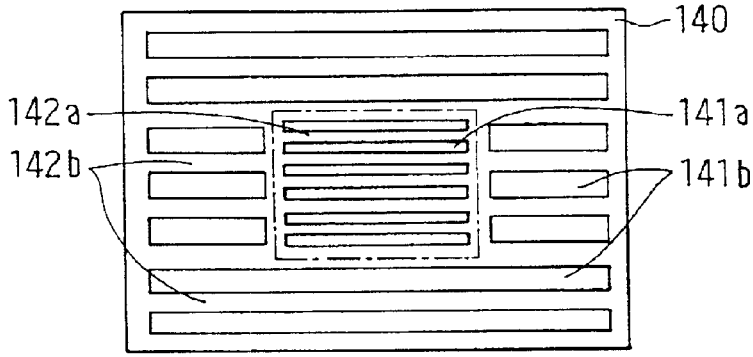
FIG. 3B is a plan view showing a plate member having openings extending in a lateral direction, according to the first embodiment.
Figure 4:
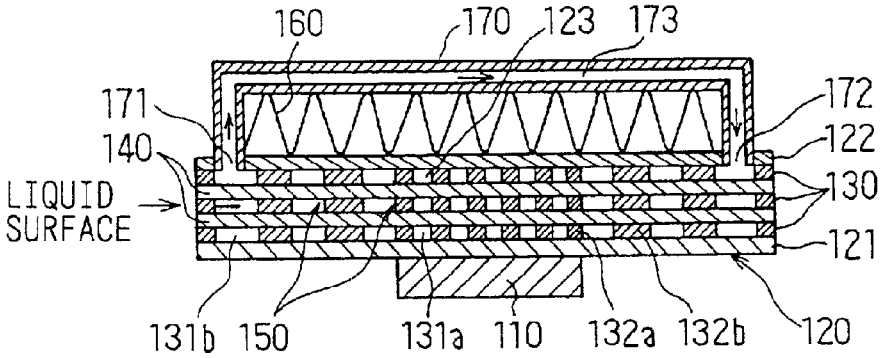
FIG. 4 is a cross-sectional view showing the cooling device taken along line IV—IV in FIG. 1.

As shown in FIGS. 2–4, the closed container 120 includes a heat reception wall 121 forming a lower-side wall surface of the container 120, a heat radiation wall 122 forming an upper-side wall surface of the container 120, and first and second plate members 130, 140. The first plate member 130 and the second plate members 140 are laminated alternately between the heat reception wall 121 and the heat radiation wall 122. These components of the closed container 120 are integrated with each other by brazing to produce the closed container 120.

The heat reception wall 121, the heat radiation wall 122, and the plate members 130, 140 are respectively formed into a rectangular shape with the same area by a metal plate such as an aluminum plate, which can be brazed and has high heat conductivity. Specifically, a clad plate member with a blazing material layer formed on an aluminum plate as a base material layer, is used as the metal plate. Each thickness of the heat reception wall 121 and the heat radiation wall 122 is made thicker than each thickness of the plate members 130, 140, to ensure a required strength of the closed container 120. In FIGS. 1, 2, 4, however, for conveniently indicating the components of the container 120, the thickness of the heat reception wall 121 and the heat radiation wall 122 is indicated to be substantially equal to the thickness of the plate members 130, 140.

As shown in FIG. 3A, plural slit-like openings 131*a*, 131*b* are provided in each of the first plate members 130 to be elongated in a vertical direction (i.e., up-down direction in FIG. 3A). The openings 131*a* are provided, in a center region indicated by a one-dot chain line, corresponding to a region (i.e., boiling region) to which the heat-generating member 110 is attached. The openings 131*b* are provided in a peripheral region of the center region. A slit width of the opening 131*a* is made smaller than a slit width of the opening 131*b*. On the other hand, as shown in FIG. 3B, plural openings 141*a* having a smaller slit width and plural openings 141*b* having a larger slit width are provided in the second plate member 140 to extend in a lateral direction (i.e., right-left direction in FIG. 3B), similarly to the first plate member 130. The openings 131*a*, 131*b*, 141*a*, 141*b* are formed by cutting, punching, etching or the like.

As shown in FIGS. 2, 4, the first plate members 130 and the second plate members 140 are alternately laminated from each other, between the heat reception wall 121 and the heat radiation wall 122. The first and second plate members 130, 140 are disposed so that the openings 131*a*, 131*b* of the first plate members 130 are crossed with the openings 141*a*, 141*b* of the second plate members 140 to communicate with the openings 141*a*, 141*b* of the second plate members 140 in a lamination direction of the plate members 130, 140, thereby providing closed spaces in the closed container 120.

Each plate thickness portion 132*a* and each plate thickness portion 132*b* are provided between adjacent both the openings 131*a* and between adjacent both the openings 131*b* in each first plate member 130, respectively. Further, each plate thickness portion 142*a* and each plate thickness portion 142*b* are provided between adjacent both the openings 141*a* and between adjacent both the openings 141*b* in each second plate member 140, respectively. The plate thickness portions 132*a*, 132*b* and the plate thickness portions 142*a*, 142*b* are connected to each other in the lamination direction of the plate members 130, 140 so as to cross each other, respectively, thereby forming pillar heat conductor portions 150. Each heat conductor 150 is formed at every position where the plate thickness portions 132*a*, 132*b* of the first plate members 130 and the plate thickness portions 142*a*, 142*b* of the second plate members 140 contact and cross each other, respectively. Each bottom end surface of the heat conductor portions 150 contacts the heat reception wall 121, and each top end surface thereof contacts the heat radiation wall 122, thereby thermally connecting the heat reception wall 121 and the heat radiation wall 122. Since the slit width of the openings 131*a*, 141*a* is made smaller in the center region (boiling region) corresponding to the attachment position of the heat-generating member 110, the heat conductor portions 150 formed by the lamination are fine in the center region.

The heat-generating member 110 is attached to the heat reception wall 121 of the closed container 120 substantially at the center portion by tightening bolts or the like. Here, heat conductor grease may be provided between the heat-generating member 110 and the heat reception wall 121 to reduce a contact heat resistance between both the heat-generating member 110 and the heat reception wall 121.

A thin plate made of a metal such as aluminum, having high heat conductivity, is formed into a wave shape to form the heat radiation fin 160, and the heat radiation fin 160 is brazed to the outside surface of the heat radiation wall 122.

The tube 170 is a plural-hole flat tube formed by extrusion using aluminum material to have plural tubular refrigerant passages 173. The tube 170 with the refrigerant passages 173 is formed substantially into a U-shape along in a refrigerant flow direction in the tubular refrigerant passages 173. The tube 170 is provided so that the heat radiation fin 160 is enclosed by the heat radiation wall 122 and the tube 170. A bottom surface of a horizontal part of the tube 170, extending horizontally, is brazed to the wave-shaped top ends of the heat radiation fin 160. Both ends 175, 176 (see FIG. 2) of the tube 170 having the refrigerant passage 173 are press-fitted into communication holes 122*a*, 122*b* provided in the heat radiation wall 122 at both end sides, and are brazed to the heat radiation wall 122, so that communication portions 171, 172 communicating with the inside of the closed container 120 are provided at the both ends 175, 176, respectively.

An injection pipe 230 shown in FIGS. 1 and 2 is inserted into a through hole 122*c*, communicating with the closed space within the closed container 120, provided in the heat radiation wall 122, to be brazed to the heat radiation wall 122. In the first embodiment, the through hole 122*c* is provided in the heat radiation wall 122. However, the through hole 122*c* can be provided in the heat reception wall 121. A predetermined amount of refrigerant such as water, alcohol, fluorocarbon and flon is poured into the closed space through the injection pipe 230, and a tip of the injection pipe 230 is sealed so that the closed space is formed. In the first embodiment, both the ends 175, 176 of the tube 170 are inserted into the communication holes 122*a*, 122*b*, respectively, to be positioned at an upper side of a liquid surface of refrigerant introduced from the injection pipe 230 into the closed container 120.

Next, operation of the cooling device 100 according to the first embodiment will be now described.

In the cooling device 100, the heat-generating member 110 can be cooled even when being disposed at any one of a bottom side of the closed container 120 (bottom posture), a lateral side thereof (lateral posture) and a top side thereof (top posture). In the first embodiment, the heat-generating member 110 is disposed on the bottom surface of the closed container 120, and the operation in this bottom posture is described.

Heat generated from the heat-generating member 110 is transmitted to the heat radiation wall 122 to be radiated to atmospheric air through the heat reception wall 121 and the heat conductor portions 150, while being transmitted to refrigerant contained in the closed container 120 through the heat reception wall 121 and the heat conductor portions 150 to boil the refrigerant.

Here, an amount of heat transmitted from the heat-generating member 110 to the heat reception wall 121 becomes smaller as a distance away from the attachment position of the heat-generating member 110 becomes larger on the heat reception wall 121. Therefore, refrigerant in the closed container 120 is boiled mainly in a region (boiling region) corresponding to the attachment position of the heat-generating member 110. The gas refrigerant boiled in this boiling region flows into an upper space 123 of the closed container 120 mainly through the openings 131*a*, 141*a* of the plate members 130, 140, and flows into the tubular refrigerant passages 173 of the tube 170 from the communication portion 171. At this time, heat of the evaporated gas refrigerant is radiated to atmospheric air as condensation latent heat through an inner wall surface of the tube 170 and the heat radiation fin 160, so that the gas refrigerant is condensed and liquefied. The condensed liquid refrigerant is returned into the closed container 120 from the communication portion 172. Thus, the heat-generating member 110 is cooled by repeating the boiling-condensation-liquefaction cycle descried above.

Next, effect of the cooling device according to the first embodiment will be described.

In the first embodiment, by providing the tube 170, refrigerant smoothly circulates from the closed container 120 to the closed container 120 through the communication portion 171, the tube 170 and the communication portion 172. Further, heat from gas refrigerant and heat from the heat-generating member 110 can be radiated from an outer wall surface of the tube 170 in addition to the heat radiation wall 122 and the heat radiation fin 160, and heat can be transmitted to the heat radiation fin 160 from both sides of the tube 170 and the heat radiation wall 122. Therefore, fin efficiency can be improved to totally improve cooling performance.

Further, since the plural tubular refrigerant passages 173 (see FIG. 2) are provided in the tube 170, a heat radiation area (condensation area) in the tube 170 can be enlarged, thereby further improving cooling performance. In the first embodiment, because the tube 170 is formed using a plural-hole flat tube formed by extrusion, production cost can be reduced.

Furthermore, because the heat conductor portions 150 can be formed by laminating the plate members 130, 140 having the openings 131*a*, 131*b*, 141*a*, 141*b* between the heat reception wall 121 and the heat radiation wall 122, the closed container 120 including the heat conductor portions 150 can be readily constructed in low cost. In addition, the slit widths of the openings 131*a*, 141*a* in the correspondence region (boiling region) of the heat-generating member 110 are made smaller than the slit widths of the openings 131*b*, 141*b* in the peripheral region of the correspondence region. Therefore, a heat conducting area of the heat conductor portions 150 can be increased in the correspondence region, refrigerant can be effectively boiled, thereby improving cooling performance.

Figure 5:
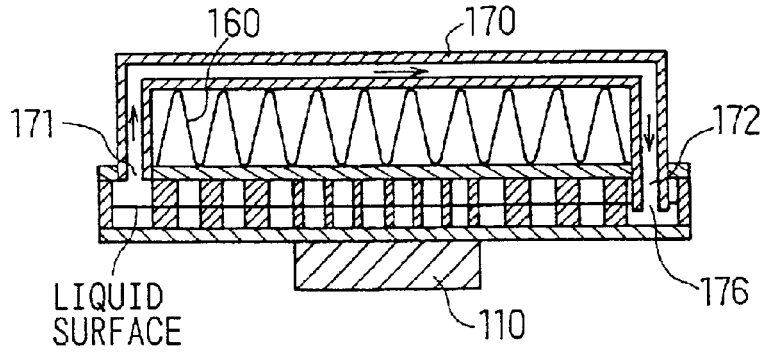
FIG. 5 is a cross-sectional view showing a cooling device according to a modification of the first embodiment.

In the first embodiment, as shown in FIG. 5, one end 176 of the tube 170 may be opened below a liquid refrigerant surface in the closed container 120. In this case, since the boiled refrigerant naturally readily flows into the tube 170 from the communication portion 171, refrigerant circulation between the closed container 120 and the tube 170 can be accelerated, and the cooling performance can be further improved.

(Second Embodiment)

In a cooling device of the second embodiment, refrigerant circulation between the closed container 120 and the tube 170 is further facilitated.

Figure 6:
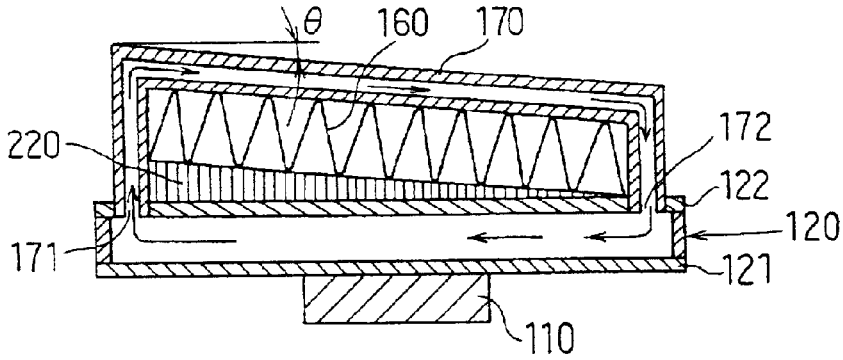
FIG. 6 is a cross-sectional view showing a cooling device according to a second preferred embodiment of the present invention.

As shown in FIG. 6, a lateral part of the tube 170 is inclined by a predetermined angle θ (e.g., 5 degrees) with respect to the wall surface of the heat reception wall 121. That is, one end position of the lateral part of the tube 170 at the side of the communication portion 171 is made higher than the other end position of the lateral part of the tube 170 at the side of the communication portion 172, so that condensed liquid refrigerant readily flows through the lateral part of the tube 170. A heat conductor member 220 having a triangular cross-section is disposed in a clearance portion provided between the heat radiation wall 122 and the heat radiation fin 160.

According to the second embodiment, since liquid refrigerant condensed from gas refrigerant readily flows through the lateral part of the tube 170 toward an inclination downward by its weight, refrigerant circulation is accelerated in the cooling device, and cooling performance of the cooling device can be further improved. In the second embodiment, the other parts are similar to those of the above-described first embodiment.

(Third Embodiment)

In a cooling device of the third embodiment of the present invention, refrigerant circulation is also facilitated. The third embodiment will be now described with reference to FIGS. 7, 8A and 8B.

Figure 7:
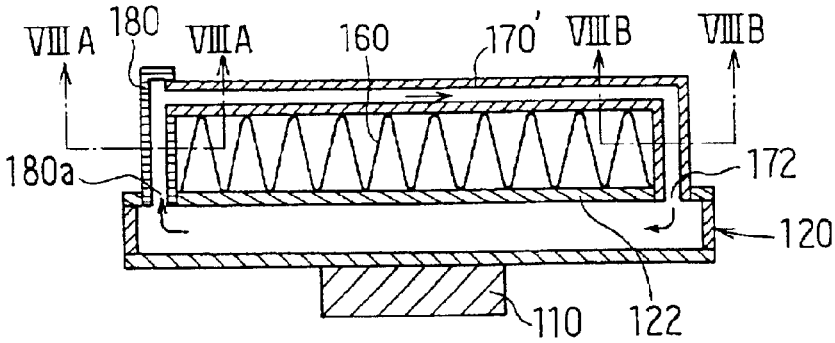
FIG. 7 is a cross-sectional view showing a cooling device according to a third preferred embodiment of the present invention.
Figure 8A:
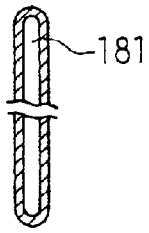
FIG. 8A is a cross-sectional view taken along line VIIIA—VIIIA in FIG. 7.
Figure 8B:
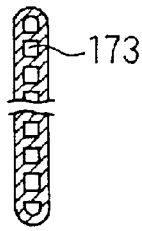
FIG. 8B is a cross-sectional view taken along line VIIIB—VIIIB in FIG. 7.

As shown FIGS. 7, 8A, 8B, a tube 170' having the plural tubular refrigerant passage 173 is formed into a L-shape in cross section by bending a flat tube with plural passages, and a connection member 180 having therein a refrigerant passage 181 is disposed to be connected to the tube 170' and the closed container 120. Accordingly, the connection portion 180 is connected to the closed container 120 to communicate with the closed container 120 through a communication-portion 180*a*. Because a passage area of the refrigerant passage 181 is made larger than a passage area of each tubular refrigerant passage 173 within the tube 170', boiled gas refrigerant readily flows into the tube 170' through the refrigerant passage 181. Thus, refrigerant circulation can be facilitated, and cooling performance can be further improved.

In the third embodiment, the heat radiation fin 160 is enclosed by the connection member 180, the tube 170' and the heat radiation wall 122. In the third embodiment, the other parts are similar to those of the above-described first embodiment.

In the third embodiment, the single refrigerant passage 181 of the connection member 180 shown in FIG. 8A can be provided at one side of the above-described tube 170 of the first embodiment in a predetermined region from the end 175 of the tube 170 by boring. Further, the length of the connection member 180 can be adjusted, and a passage area of the refrigerant passage 181 can be adjusted.

(Fourth Embodiment)

In a cooling device of the fourth embodiment, the refrigerant circulation is also facilitated.

Figure 9:
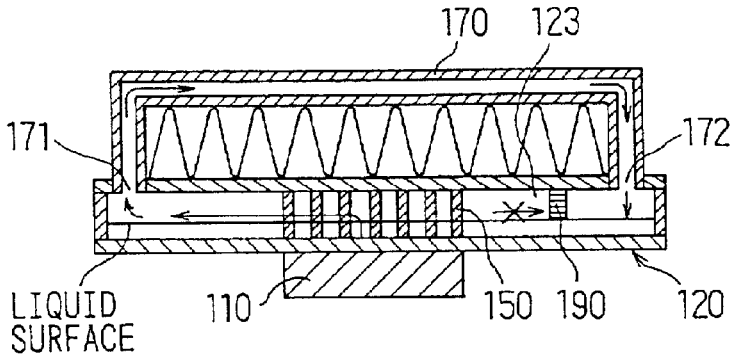
FIG. 9 is a cross-sectional view showing a cooling device according to a fourth preferred embodiment of the present invention.

As shown in FIG. 9, a partition portion 190 for partitioning the upper space 123 above the liquid refrigerant surface within the closed container 120 is provided between the heat conductor portions 150 in the correspondence region of the heat-generating member 110 and the communication portion 172 of the tube 170.

Accordingly, the gas refrigerant boiled in the correspondence region of the heat-generating member 110 does not flow into the side of the communication portion 172 due to the partition portion 190, but it naturally readily flows into the tube 170 from the communication portion 171 to be condensed and liquefied therein. Then, the condensed liquid refrigerant returns into the closed container 120 from the communication portion 172. Since the refrigerant circulation direction is regulated, the refrigerant circulation can be facilitated, and cooling performance can be improved.

In the fourth embodiment, the other parts are similar to those of the above-described first embodiment.

(Fifth Embodiment)

In a cooling device of the fifth embodiment, cooling performance is improved by effectively using cooling air supplied to the heat radiation fin 160.

Figure 10:
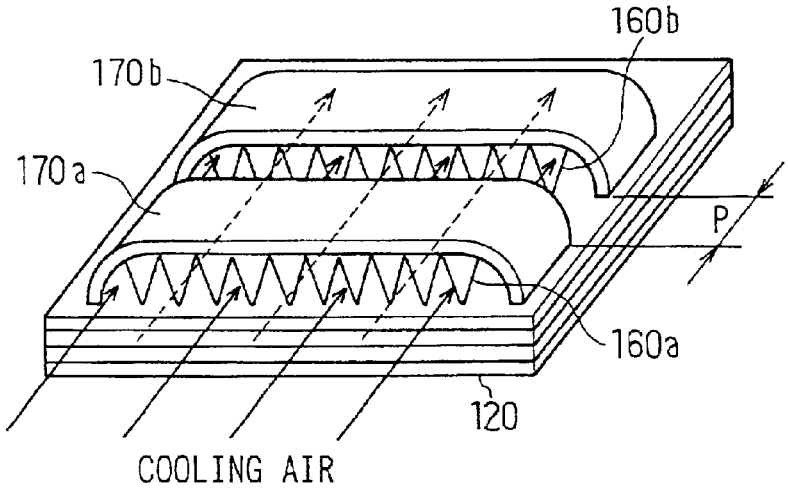
FIG. 10 is a schematic perspective view showing a cooling device according to a fifth preferred embodiment of the present invention.

In the fifth embodiment, each of the heat radiation fin 160 and the tube 170 is separated into plural members in a flowing direction of cooling air. For example, as shown in FIG. 10, the heat radiation fin 160 and the tube 170 are separated into two heat radiation fins 160*a*, 160*b* and two tubes 170*a*, 170*b*, respectively in the flowing direction of cooling air, so that a clearance P is provided between the tube 170*a* (upstream heat radiation fin 160*a*) and the tube 170*b* (downstream heat radiation fin 160*b*).

When each of the heat radiation fin 160 and the tube 170 is provided as a single member when the closed container 120 is made longer in the flowing direction of cooling air, temperature of cooling air flowing through the heat radiation fin 160 is increased due to heat-exchange in the heat radiation fin 160. In the fifth embodiment, as shown in FIG. 10, cooling air, indicated by the solid-line arrows, after being heat-exchanged in the heat radiation fin 160*a*, is cooled in a region (separation region) of the clearance P, by cooling air indicated by broken-line arrows flowing outside the tube 160. Thereafter, cooling air having being cooled in the region of the clearance P flows through the heat radiation fin 160*b*. Accordingly, cooling performance of the cooling device can be further improved.

In the fifth embodiment, similarly to that in the first and second embodiments, the slit widths of the openings 131*a*, 141*a* in the correspondence region of the heat-generating member 110 are made smaller. Further, the tube 170 can be provided to be inclined with respect to the heat reception wall 121. According to a combination of the fifth embodiment with the first embodiment or/and the second embodiment, refrigerant is effectively boiled by the fine heat conductor portions 150, refrigerant circulation is facilitated between the closed container 120 and in the tube 170, thereby further improving cooling performance.

(Sixth Embodiment)

Figure 11:
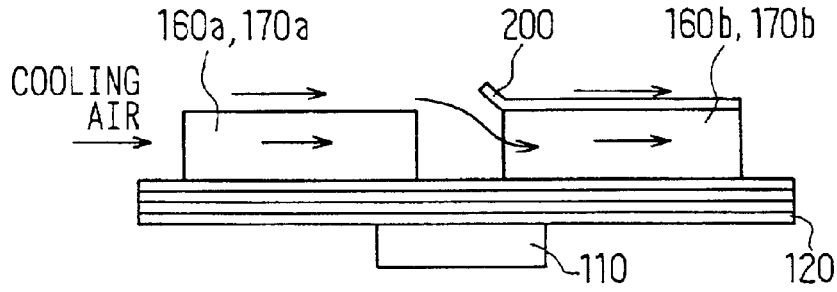
FIG. 11 is a side view showing a cooling device according to a sixth preferred embodiment of the present invention.

In a cooling device of the sixth embodiment, cooling air is more effectively supplied to the heat radiation fin 160. As shown in FIG. 11, an air flow control plate 200 for adjusting a flow direction of cooling air to the heat radiation fin 160*b* is provided on the tube 170*b* at an upstream air side end. That is, the air flow control plate 200 protrudes from the upstream air side end of the tube 170*b* to be tilted upwardly toward an upstream air side.

Accordingly, low-temperature cooling air flowing outside the tube 170*a* can be supplied into the heat radiation fin 160*b*, thereby increasing an air flow amount, and further improving cooling performance.

(Seventh Embodiment)

Figure 12:
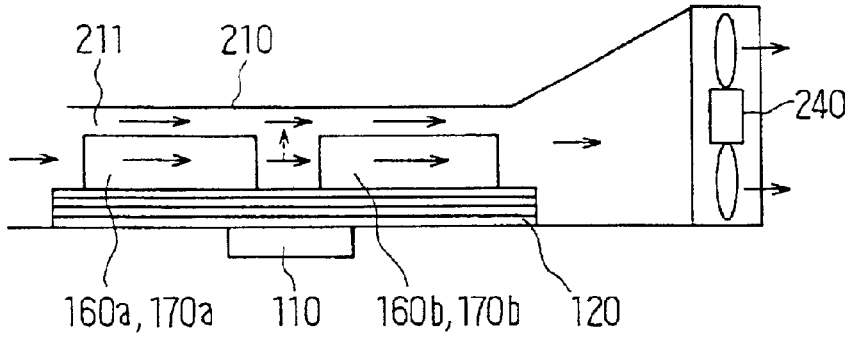
FIG. 12 is a side view showing a cooling device according to a seventh preferred embodiment of the present invention.

In a cooling device of the seventh embodiment, cooling performance is improved when a duct 210 in which cooling air flows is provided, as shown in FIG. 12.

The duct 210, through which cooling air blown by a blower 240 flows, is provided to accommodate the heat radiation fins 160*a*, 160*b* and the tubes 170*a*, 170*b* from the outside, and a clearance portion 211 through which air flows is provided between the duct 210 and the tubes 170*a*, 170*b*. Therefore, cool air passes through the clearance portion 211 while bypassing the heat radiation fin 160*a*.

Thus, cooling air after passing through the heat radiation fin 160*a* is cooled by cooling air passing through the clearance portion 211 in the separation region between the heat radiation fins 160*a*, 160*b*, thereby improving cooling performance.

Here, when the air flowing control plate 200 is provided similarly to the above-described sixth embodiment, cooling performance can be further improved.

(Eighth Embodiment)

In a cooling device of the eighth embodiment, cooling performance is improved by reducing air flow resistance in the heat radiation fin 160.

Figure 13:
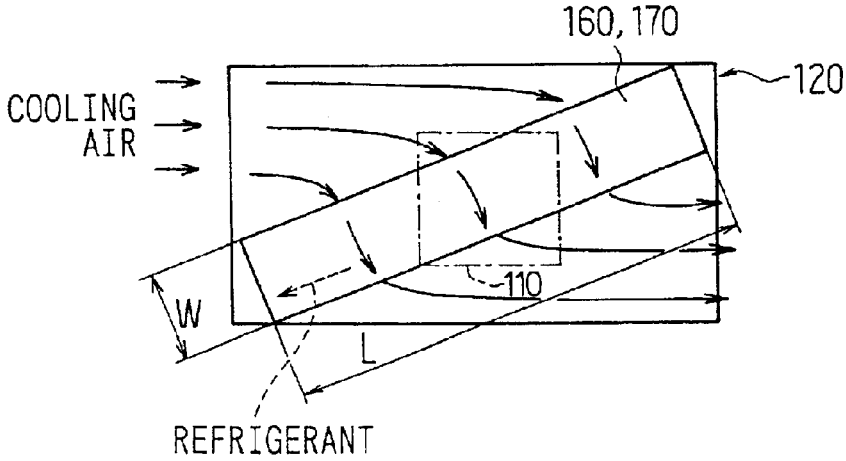
FIG. 13 is a plan view showing a cooling device according to an eighth preferred embodiment of the present invention.

As shown in FIG. 13, in the eighth embodiment, when a length of the closed container 120 in the flowing direction of cooling air is longer than a width thereof in a direction perpendicular to the flowing direction of cooling air, the tube 170 and the heat radiation fin 160 are disposed so that a dimension W of the heat radiation fin 160 and the tube 170 in the cooling-air flowing direction is made smaller than a dimension L thereof in a refrigerant flowing direction within the tube 170. The heat radiation fin 160 and the tube 170 are inclined by a predetermined angle relative to the cooling-air flowing direction. Specifically, the heat radiation fin 160 and the tube 170 are arranged substantially along a diagonal line of the closed container 120.

Accordingly, the dimension W of the heat radiation fin 160 in the flowing direction of cooling air is made smaller to reduce the air passage resistance, and the dimension L of the heat radiation fin 160 in the refrigerant flowing direction is made longer along the diagonal line of the closed container 120 to increase an area of opening through which cooling air flows. Therefore, a flow amount of cooling air flowing through the heat radiation fin 160 can be increased, and cooling performance can be improved.

(Ninth Embodiment)

Figure 14:
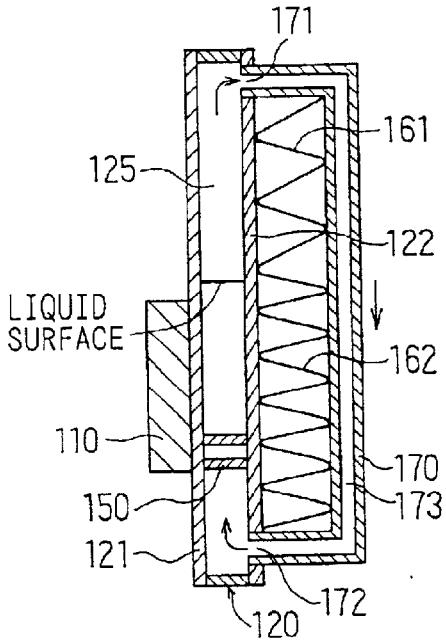
FIG. 14 is a cross-sectional view showing a cooling device according to a ninth preferred embodiment of the present invention.

In a cooling device of the ninth embodiment, cooling performance is improved when the heat-generating member 110 is disposed in a side posture as in FIG. 14.

Figure 15A:
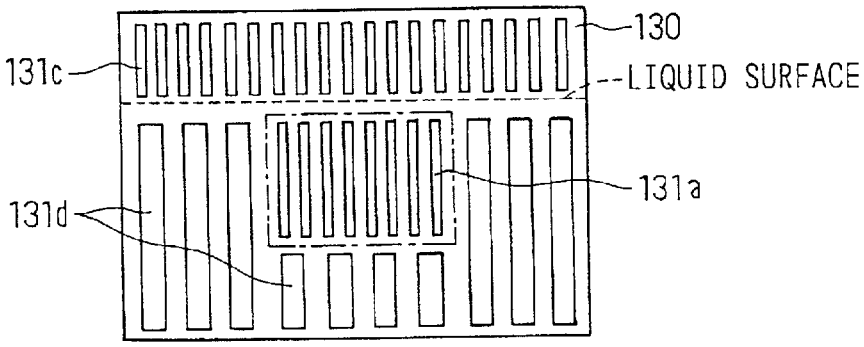
FIG. 15A is a plan view showing a plate member having openings extending in a vertical direction.
Figure 15B:
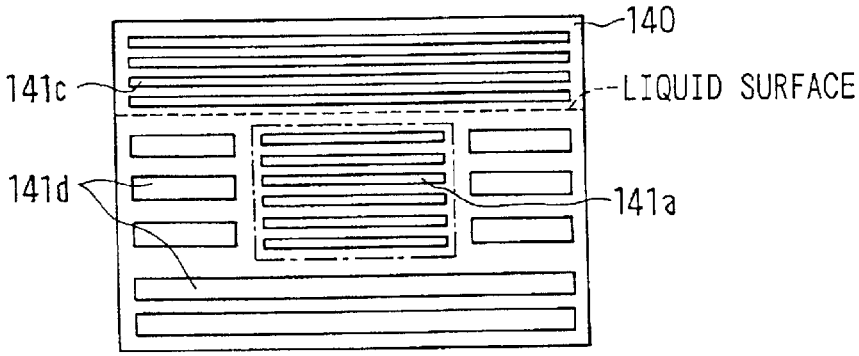
FIG. 15B is a plan view showing a plate member having openings extending in a lateral direction, according to the ninth embodiment.

As shown in FIGS. 15A, 15B, the plate members 130, 140 disposed in the closed container 120 have the openings 131*a*, 141*a*, whose slit width is small similarly to the first embodiment, in the region corresponding to the attachment position of the heat-generating member 110, respectively. In the ninth embodiment, openings 131*c*, 141*c*, each having a small slit width, are provided in the positions of the plates 130, 140, above the liquid refrigerant surface, and openings 131*d*, 141*d*, each having a slit width larger than each slit width of the openings 131*a*, 141*a* and the openings 131*c*, 141*c*, are provided in the liquid refrigerant area under the liquid refrigerant surface around the areas of the openings 131, 141. Thus, in the closed container 120 of the ninth embodiment, the fine heat conductor portions 150 are formed in the region corresponding to the attachment position of the heat-generating member 110 and in the region above the liquid refrigerant surface.

As shown in FIG. 14, the liquid refrigerant surface is set between the communication portions 171, 172 through which the tube 170 communicates with the closed container 120, and is set to be positioned as lower as possible. In addition, the heat-generating member 110 is disposed under the liquid refrigerant surface.

Further, a fin density is made smaller in an upper side fin 161 disposed above the liquid refrigerant surface, than a fin density in a lower side fin 162 disposed below the liquid refrigerant surface. Specifically, the fin pitch fp in the upper side fin 161 is made larger than the fin pitch fp in the lower side fin 162.

Next, operation of the cooling device according to the ninth embodiment, where the heat-generating member 110 is disposed in the side posture, will be now described.

Heat generated in the heat-generating member 110 is transmitted to the heat radiation wall 122 from the heat reception wall 121 through the heat conductor portions 150 to be radiated to atmospheric air from both of the fins 161, 162, while being transmitted into refrigerant in the closed container 120 through the heat reception wall 121 and the heat conductor portions 150 to boil refrigerant.

Heat transmitted from the heat-generating member 110 to the heat reception wall 121 is transmitted to refrigerant through the heat conductor portions 150, so that refrigerant boils in the boiling region. Gas refrigerant boiled in the boiling region moves upwardly into an upper space 125 mainly through the openings 131*a*, 141*a* of the plate members 130, 140, and flows into the tube 170 through the communication portion 171 at an upper side. At this time, gas refrigerant radiates heat to atmospheric air as a condensation latent heat through an inner wall surface of the tube 170 and the fins 161, 162 to be condensed and liquefied. The condensed liquid refrigerant moves downward by its weight to return into liquid refrigerant area within the closed container 120 through the communication portion 172. Thus, the heat-generating member 110 is cooled by repeating the boiling-condensation-liquefaction cycle descried above.

Next, description will be made on an operational effect of the cooling device in the ninth embodiment.

Because the tube 170 is disposed to communicate with the closed container 120 at the upper and lower sides of the liquid refrigerant surface, refrigerant circulates from the closed container 120 to the closed container 120 through the communication portion 171, the tube 170 and the communication portion 172, thereby facilitate refrigerant circulation and improving cooling performance in the cooling device. Further, heat generated from the heat-generating member 110 can be radiated from an outer wall surface of the tube 170 in addition to the heat radiation wall 122 and the heat radiation fin 160, while being transmitted to the heat radiation fin 160 from both sides of the tube 170 and the heat radiation wall 122. Therefore, fin efficiency can be improved to totally improve cooling performance, similarly to the above-described first embodiment.

Further, since the heat-generating member 110 is disposed at the lower side of the liquid refrigerant surface, heat from the heat-generating member 110 can be effectively transmitted to liquid refrigerant to boil the liquid refrigerant. Since a heat transmittance area of the heat conductor portions 150 can be made larger in the boiling region, refrigerant can be effectively boiled.

Furthermore, the heat transmitting area of the heat conductor portions 150 can be made larger above the liquid refrigerant surface by fining the slit width of the opening portions 131*c*, 141*c*, and the flow amount of cooling air is increased due to the reduction of the cooling-air passage resistance in the region of the upper side fin 161. Therefore, the boiled refrigerant is effectively cooled and condensed in the upper space within the closed container 120, thereby improving cooling performance.

(Tenth Embodiment)

In a cooling device of the tenth embodiment, cooling performance is improved by reducing cooling-air passage resistance in the heat radiation fin 160, similarly to the above-described ninth embodiment.

Figure 16:
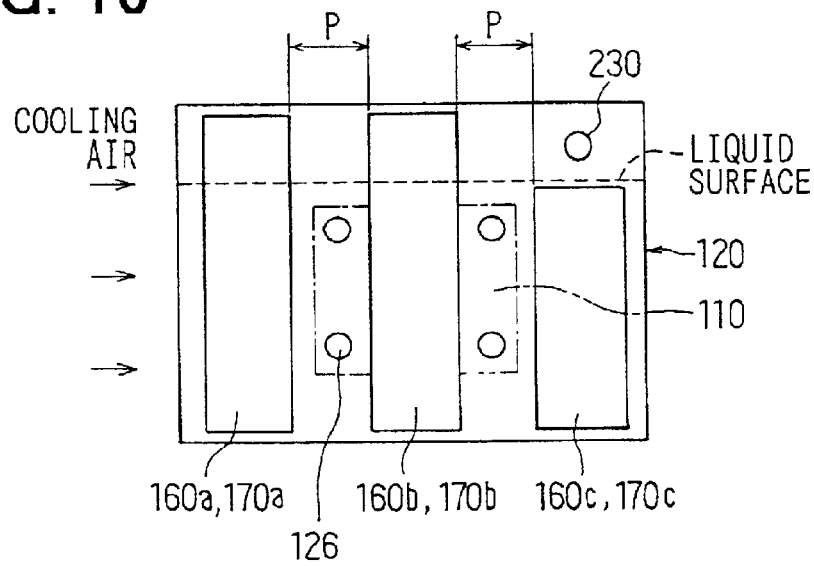
FIG. 16 is a side view showing a cooling device according to a tenth preferred embodiment of the present invention.

Each of the heat radiation fin 160 and the tube 170 is separated into plural members in the flowing direction of cooling air, similarly to the above-described fifth embodiment, so that a clearance P is provided between adjacent two members in the flowing direction of cooling air. In FIG. 16, for example, the heat radiation fin 160 and the tube 170 are separated into three heat radiation fins 160*a*,

160*b,* 160*c* and three tubes 170*a,* 170*b,* 170*c,* respectively. Further, the heat radiation fin 160*c* and the tube 170*c* at the most downstream air side are only provided under the liquid refrigerant surface. That is, the upper side parts of the heat radiation fin 160*c* and the tube 170*c,* above the liquid refrigerant surface, are omitted.

In the region where the fin 160*c* and the tube 170*c* are eliminated, a refrigerant injection pipe 230 is provided. In the regions of the clearance P, through holes 126 are provided in the heat reception wall 121, and the heat-generating member 110 is fixed to the heat reception wall 121 using bolts or the like.

Accordingly, the cooling-air passage resistance becomes smaller in the fin parts above the liquid refrigerant surface, and the flow amount of cooling air is increased in this fin parts. Therefore, the boiled gas refrigerant is effectively cooled in the upper space within the closed container 120 to improve cooling performance.

In the tenth embodiment, the injection pipe 230 is provided in the region where the heat radiation fin 160*c* and the tube 170*c* are omitted, and the heat-generating member 110 is fixed by effectively using the regions of the clearances P. Specifically, the heat-generating member 110 is surely fitted and fixed to the heat reception wall 121 by fastening nuts to bolts after the bolts pass through the through holes from tip sides, respectively. Accordingly, the heat-generating member 110 and the injection pipe 230 can be readily attached to the closed container 120.

(Eleventh Embodiment)

In a cooling device of the eleventh embodiment, cooling performance can be improved even when the heat-generating member 110 is disposed on the top position of the closed container.

Figure 17:
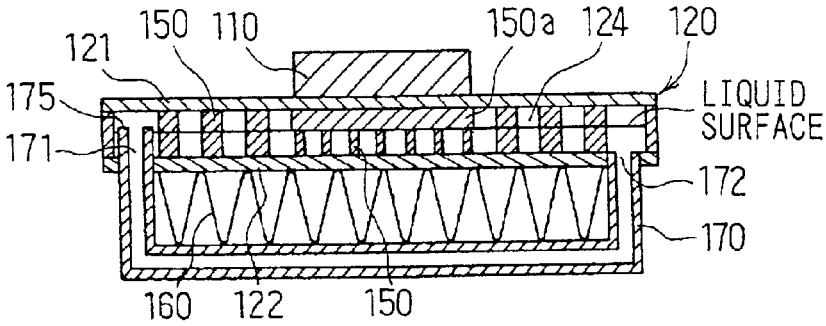
FIG. 17 is a cross-sectional view showing a cooling device according to an eleventh preferred embodiment of the present invention.

As shown in FIG. 17, in the eleventh embodiment, the end 175 of the tube 170 is opened above the liquid refrigerant surface in the closed container 120 at a side of the communication portion 171. In addition, an inner volume of the closed container 120 is made larger than an inner volume of the tube 170.

Further, plural plate members 130, 140 are laminated, and the openings 131*a,* 141*a* of the plate members 130, 140 in the correspondence region of the heat-generating member 110 are eliminated in the upper space 124 above the liquid refrigerant surface, so that the heat conductor portions 150 in the correspondence region are continuously integrated as a heat conductor portion 150*a* in the upper space 124, as shown in FIG. 17. Below the liquid refrigerant surface directly under the heat conductor portion 150*a,* the slit width of the openings 131*a,* 141*a* is made smaller, so that the heat conductor portions 150 is made thinner in the correspondence region, as compared with the other part.

Next, operation of the cooling device will be described when the heat-generating member 110 is disposed on the top side of the closed container 120.

Heat generated from the heat-generating member 110 is transmitted to the heat radiation fin 122 from the heat reception wall 121 through the heat conductor portions 150*a,* 150 to be radiated to atmospheric air. The heat is also radiated to atmospheric air from the tube 170 to the heat radiation fin 160. The heat is transmitted to refrigerant around each heat conductor portion 150, and the refrigerant is boiled in the boiling region. The gas refrigerant boiled in the boiling region circulates within the upper space 124 above the liquid refrigerant surface. While gas refrigerant flows through the upper space 124, the gas refrigerant radiates heat to atmospheric air as condensation latent heat through an inner wall of the closed container 120, mainly through the heat reception wall 121, a side wall surface of the closed container 120, wall surfaces of the heat conductor portions 150 and the like. As a result, the gas refrigerant is condensed to be liquefied. The condensed liquid refrigerant is returned to the boiling region to repeat the boiling-condensation-liquefaction cycle descried above, thereby cooling the heat-generating member 110.

Next, description will be made on an effect of the cooling device according to the eleventh embodiment.

When the heat-generating member 110 is used in the top posture, the liquid refrigerant surface is need to be positioned above the heat radiation wall 122 in order to effectively transmitting heat of the heat-generating member 110 to refrigerant. When the heat-generating member 110 is used in the bottom posture, a volume of the upper space 123 within the closed container 120 is made larger, and a depth of liquid refrigerant from the heat reception wall 121 to the liquid refrigerant surface is made lower, in order to improve the heat transmitting effect. In the present invention, since the inner volume of the tube 170 is small, even if the cooling device in which the heat-generating member 110 is disposed in the bottom posture is reversely used in the up-down direction, the liquid refrigerant surface can be readily positioned above the heat radiation wall 122. Therefore, in this eleventh embodiment, the cooling device can be suitablely used in the bottom posture.

Further, because the heat conductor portion 150*a* above the liquid refrigerant surface is a continuously integrated conductor member without the opening portions 131*a,* 141*a* in the correspondence region of the heat-generating member 110, heat conduction area can be made larger. Therefore, heat from the heat-generating member 110 can be effectively transmitted to the heat conductor portions 150 below the liquid refrigerant surface. Since heat conduction area of the heat conductor portions 150 under the liquid refrigerant surface can be made larger by making the heat conductor portions 150 thinner in the correspondence region of the heat-generating member 110, refrigerant can be effectively boiled.

Even in the cooling device shown in FIG. 17, because heat from the heat-generating member 110 can be radiated through the outer wall surface of the tube 170 in addition to the heat conductor portions 150, the heat radiation wall 122 and the heat radiation fin 160, heat radiation area can be made larger. Further, the heat can be transmitted to the heat radiation fin 160 from both of the tube 170 and the heat radiation wall 122, thereby improving fin efficiency and cooling performance.

(Twelfth Embodiment)

In a cooling device of the twelfth embodiment, refrigerant is further effectively boiled for improving cooling performance.

Figure 18:
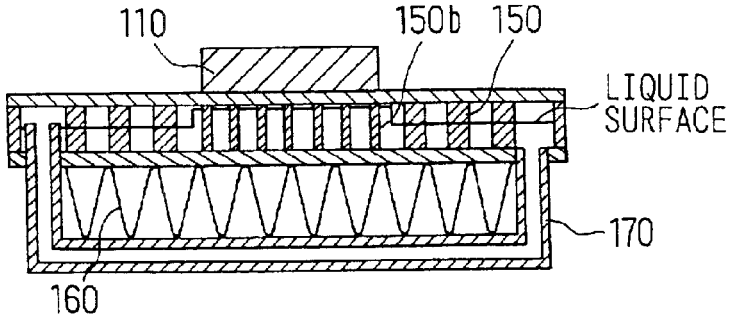
FIG. 18 is a cross-sectional view showing a cooling device according to a twelfth preferred embodiment of the present invention.

In the twelfth embodiment of the present invention, each of the heat conductor portions 150*b* shown in FIG. 18 is formed into a structure (wick structure) having a core metal and a porous material such as a sintered metal and fibers on the surface of the core metal. The heat conductor portions 150*b* are disposed in the correspondence region of the heat-generating member 110. Accordingly, refrigerant on the liquid refrigerant surface can be readily moved upward due to a capillary action in this structure. Thus, thermal resistance can be reduced between the heat-generating member 110 and the liquid refrigerant surface, and heat conduction area can be enlarged, thereby effectively boiling refrigerant and improving cooling performance.

(Thirteenth Embodiment)

Figure 19:
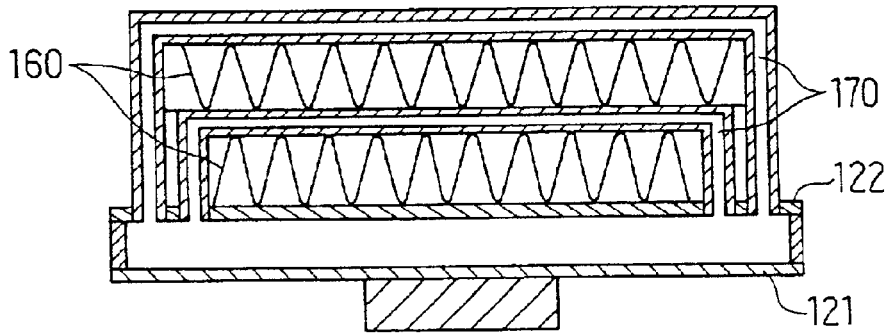
FIG. 19 is a cross-sectional view showing a cooling device according to a thirteenth preferred embodiment of the present invention.

In a cooling device of the thirteenth embodiment, as shown in FIG. 19, plural heat radiation fins 160 and plural tubes 170 are provided in a direction from the heat reception wall 121 to the heat radiation wall 122. That is, the plural heat radiation fins 160 and the plural tubes 170 are overlapped. Accordingly, heat radiation area of the heat radiation fin 160 and the tube 170 can be enlarged as required, thereby improving cooling performance.

(Fourteenth Embodiment)

Figure 20A:
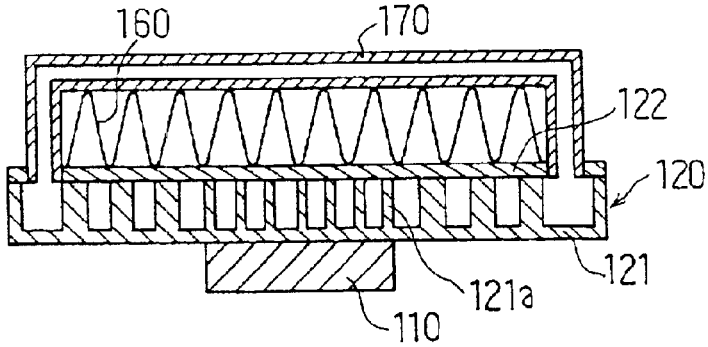
FIGS. 20A and 20B are cross-sectional views each showing a cooling device according to a fourteenth preferred embodiment of the present invention.
Figure 20B:
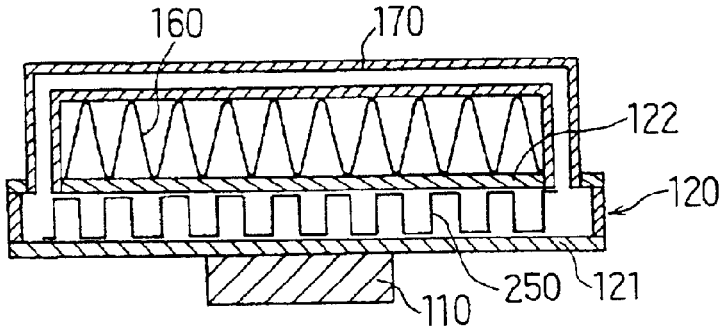

In the above-described first embodiment, the heat conductor portions 150 are formed by alternately laminating the plate members 130, 140. However, in a cooling device of the fourteenth embodiment, as shown in FIG. 20A, plural protrusion portions 121*a* protruding from the inner surface of the heat reception wall 121 toward the heat radiation wall 122 are formed as the heat conductor portions 150 by machining or the like. The heat conductor portions 150 may be formed by protrusion portions protruding from the inner surface of the heat radiation wall 122 toward the heat reception wall 121. In addition, the protrusion sectional shapes of the protrusion portions protruding from the inner surface of the heat radiation wall 122 or the heat reception wall 121 can be suitably changed. Alternatively, an inner fin 250 having a crank-like cross-section, shown in FIG. 20B, can be provided as the heat conductor portions 150 to be position between both the heat reception wall 121 and the heat radiation wall 122 within the closed container 120. The inner fin 250 can be disposed between both the heat reception wall 121 and the heat radiation wall 122 after being separately formed from the heat reception wall 121 and the heat radiation wall 122.

Even in the cooling device of the fourteenth embodiment, cooling performance can be improved.

(Fifteenth Embodiment)

Figure 21:
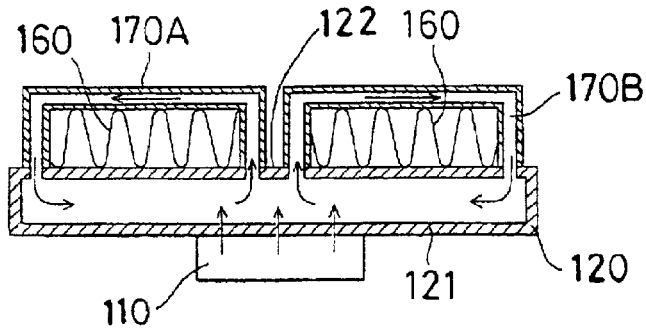
FIG. 21 is a cross-sectional view showing a cooling device according to a fifteenth preferred embodiment of the present invention.

In a cooling device of the fifteenth embodiment, as shown in FIG. 21, a first tube 170A and a second tube 170B separated from each other are arranged in a direction (right and left direction in FIG. 21) crossing the flowing direction of cooling air. That is, the first tube 170A having both ends communicating with the closed container 120 and the second tube 170B having both ends communicating with the closed container 120 are arranged in a direction approximately perpendicular to the flowing direction of cooling air passing through the fins 160.

One side ends of the first and second tubes 170A, 170B communicate with the closed container 120 in the region (boiling region) corresponding to the attachment area of the heat-generating member 110 above the heat-generating member 110. The other side ends of the first and second tubes 170A, 170B communicate with the closed container 120 at both ends of the heat radiation wall 122, respectively.

Accordingly, refrigerant boiled within the closed container 120 can flow preferentially into the first and second tubes 170A, 170B through the one side ends opened in the boiling region, respectively. As a result, refrigerant can flow in the first and second tubes 170A, 170B in directions from the one side ends to the other side ends to return into the closed container 120 through the other side ends, respectively. Accordingly, the boiled refrigerant hardly flow into the first and second tubes 170A, 170B from the other side ends, respectively. Therefore, refrigerant circulation can be facilitated, and the cooling performance can be improved.

Further, the first and second tubes 170A, 170B constructing the above-described tube 170 are separated from each other. Therefore, a refrigerant circulation root can be made shorter, refrigerant flow resistance (pressure loss) can be reduced, and cooling performance can be improved.

In the cooling device of the fifteenth embodiment, when the closed container 120 is disposed horizontally as shown in FIG. 21, a horizontal length of the first and second tubes 170A, 170B can be shorter as compared with the single tube 170 described in the first embodiment. Therefore, an amount of the condensed liquid refrigerant staying in the tubes 170A, 170B can be made smaller than that in the first embodiment. As a result, fin temperature reduction (thermal resistance increase at a condensation portion) due to the liquid refrigerant stay can be restricted, thereby further improving cooling performance.

As shown in FIG. 21, when the heat-generating member 110 is disposed to be connected to the heat reception wall 121 substantially at a center portion in the arrangement direction of the first and second tubes 170A, 170B, the first and second tubes 170A, 170B can be formed in the same shape, thereby reducing production cost.

Figure 22:
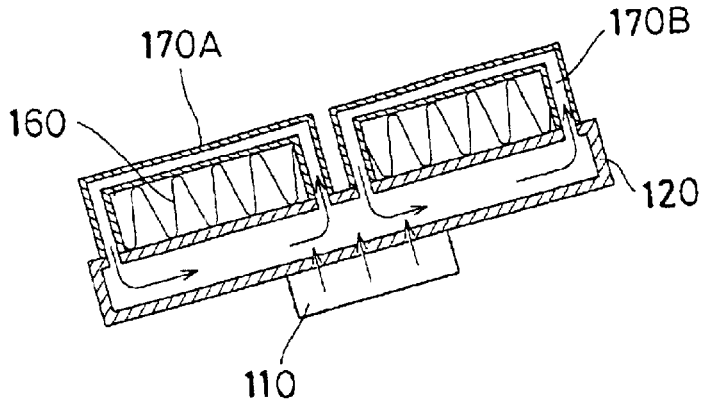
FIG. 22 is a cross-sectional view showing a cooling device according to a modification of the fifteenth embodiment.

Even when a using state of the cooling device according to the fifteenth embodiment changes, the cooling performance can be improved. Specifically, as shown in FIG. 22, even when the closed container 120 is disposed to be tilted relative to the horizontal direction, refrigerant can flow in the first and second tubes 170A, 170B in the same direction, that is, counterclockwise in FIG. 22, and refrigerant circulation can be smoothly performed.

Figure 23:
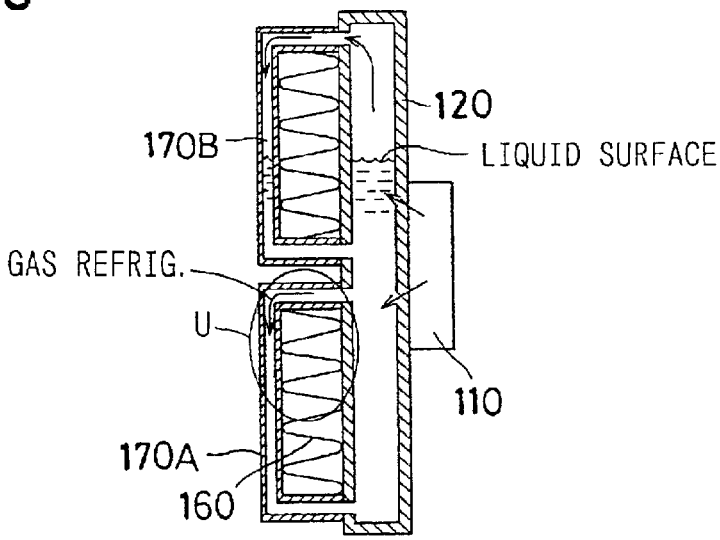
FIG. 23 is a cross-sectional view showing a cooling device according to an another modification of the fifteenth embodiment.

Alternatively, as shown in FIG. 23, when the closed container 120 is disposed vertically (side posture), the boiled gas refrigerant can also flow into the first tube 170A disposed below the liquid refrigerant surface through the one side end, and the condensed liquid refrigerant can return into the closed container 120 from the other side end. Accordingly, fin temperature can be increased in the portion indicated by U, and the cooling performance can be improved.

(Sixteenth Embodiment)

Figure 24:
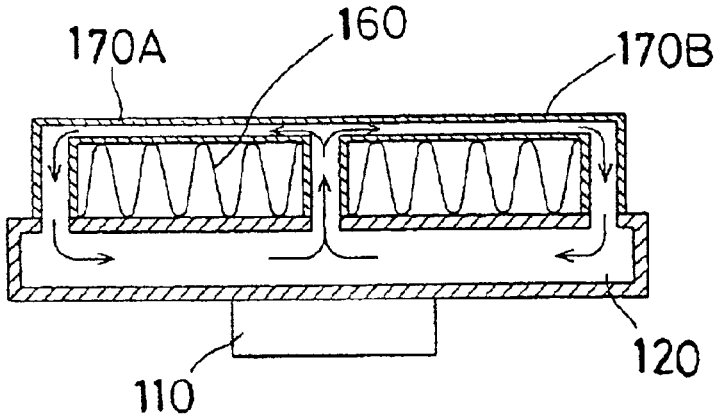
FIG. 24 is a cross-sectional view showing a cooling device according to a sixteenth preferred embodiment of the present invention.

In a cooling device of the sixteenth embodiment, as shown in FIG. 24, a single common end is provided for the one side ends of the first and the second tubes 170A, 170B. According to this construction, since the common end is formed as the one side ends of the first and second tubes 170A, 170B, a cross-section area of an inlet passage at the common end, from which the boiled gas refrigerant flows, can be designed to be increased. Therefore, refrigerant flow resistance can be reduced, and cooling performance can be improved.

(Seventeenth Embodiment)

Figure 25:
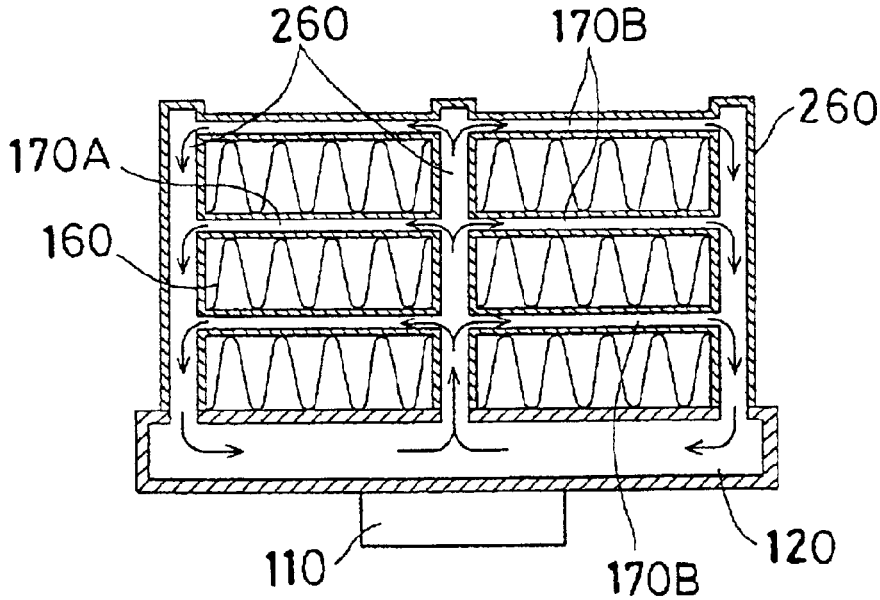
FIG. 25 is a cross-sectional view showing a cooling device according to a seventeenth preferred embodiment of the present invention.

In a cooling device of the seventeenth embodiment, as shown in FIG. 25, not only the common end is formed as the one side ends of the first and second tubes 170A, 170B, but also the heat radiation fins 160 and the tubes 170A, 170B are respectively stacked in plural stages in their height direction to form a lamination structure. In this case, a refrigerant passage extending vertically with respect to the heat radiation wall 122 may be provided as a common header tank 260.

According to the seventeenth embodiment, since the heat radiation area can be enlarged, the boiled gas refrigerant can readily move into the tubes 170A, 170B from the closed container 120, thereby improving the refrigerant circulation performance and the cooling performance.

(Eighteenth Embodiment)

Figure 26:
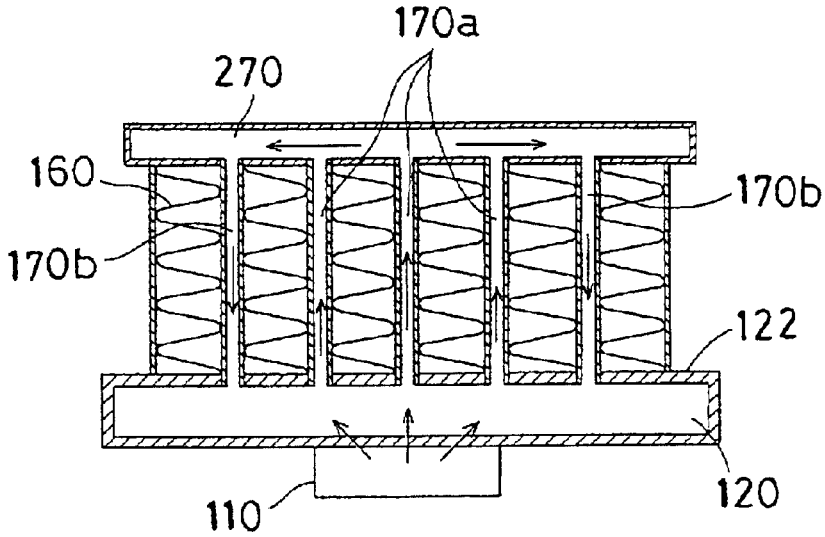
FIG. 26 is a cross-sectional view showing a cooling device according to an eighteenth preferred embodiment of the present invention.

In a cooling device of the eighteenth embodiment, as shown in FIG. 26, plural tubes 170*a*, 170*b* are provided to extend vertically with respect to the heat radiation wall 122, and are communicated with each other at upper ends thereof by a single header tank 270. In FIG. 26, for example, three tubes 170*a* are provided to communicate with the closed container 120 substantially in the boiling region, and two tubes 170*b* are provided at both sides to communicate with the closed container 120 outside the boiling region.

According to this construction, the gas refrigerant boiled in the closed container 120 flow preferentially into the three tubes 170*a* at the center portion, and is cooled to be condensed. Thereafter, the condensed refrigerant returns into the closed container 120 from the two tubes 170*b* at both the sides. Even in this cooling device, refrigerant circulation can be regulated, and the cooling performance can be improved.

(Nineteenth Embodiment)

Figure 27:
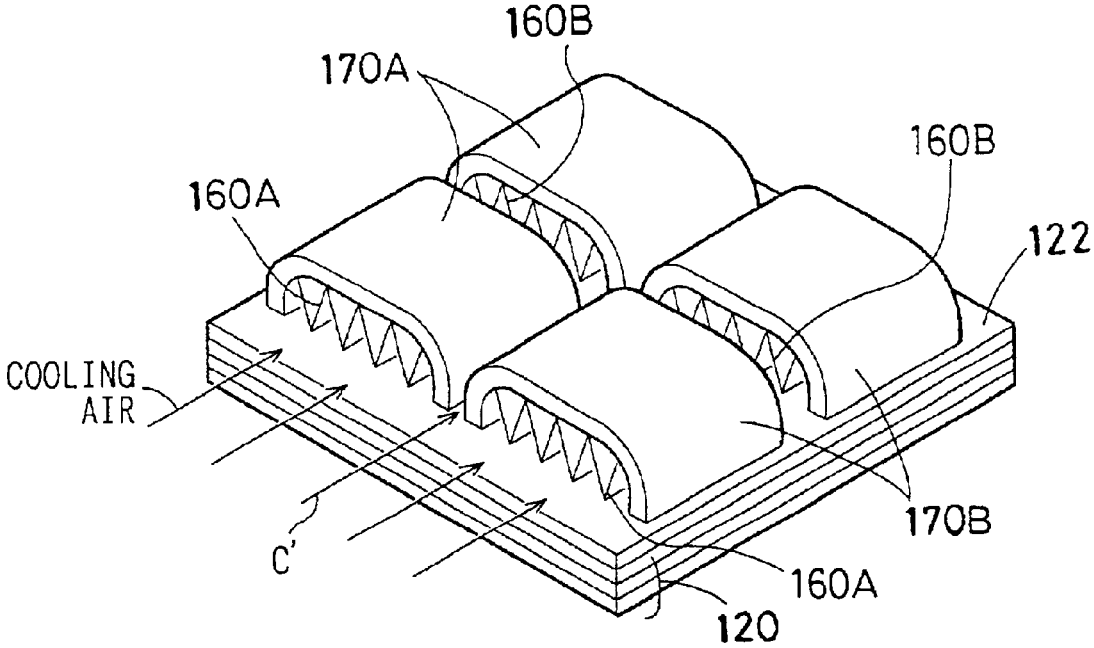
FIG. 27 is a perspective view showing a cooling device according to a nineteenth preferred embodiment of the present invention.

In a cooling device of the nineteenth embodiment, as shown in FIG. 27, plural first tubes 170A and plural second tubes 170B are respectively arranged on the heat radiation wall 122 in the flowing direction of cooling air. Further, adjacent both the first and second tubes 170A, 170B are arranged in a direction approximately perpendicular to the flowing direction of cooling air to have a clearance therebetween. Accordingly, cooling air passes through between the first tube 170A and the second tube 170B at an upstream air side as shown by arrow C', while bypassing heat radiation fins 160A at the upstream air side. The cooling air, bypassing the heat radiation fins 160A indicated by arrow C', can be introduced into the heat radiation fins 160B at a downstream air side. As a result, the heat radiation fins 160B at the downstream air side can be effectively used for a heat exchange, thereby improving cooling performance.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A cooling device for boiling and condensing refrigerant to cool a heat-generating member, the cooling device comprising:

a container for containing liquid refrigerant, the container including a heat reception wall onto which a heat-generating member is attached outside the container, and a heat radiation wall that is substantially parallel to the heat reception wall and disposed opposite to the heat reception wall;

a heat conductor portion provided in the container, for thermally connecting the heat reception wall and the heat radiation wall;

a heat radiation fin disposed outside the container to radiate heat generated from the heat-generating member to the outside through the heat reception wall, the heat conductor portion and the heat radiation wall; and a tube disposed around the heat radiation fin, to enclose the heat radiation fin within the heat radiation wall, wherein:

the tube has two end portions disposed to communicate with an inner space of the container; and the two end portions of the tube extend through the heat radiation wall in a direction substantially perpendicular to the heat radiation wall and substantially perpendicular to the heat reception wall.

2. The cooling device according to claim 1, wherein the heat radiation fin is disposed to be inserted in a space defined at least by the tube and the heat radiation wall.

3. The cooling device according to claim 1, wherein the tube is connected to the container in such a manner that gas refrigerant boiled by heat generated from the heat-generating member passes through the tube while being condensed by cooling air passing through the heat radiation fin.

4. The cooling device according to claim 1, wherein the tube defines a plurality of tubular refrigerant passages each of which extends in a refrigerant flow direction.

5. The cooling device according to claim 1, wherein:

the tube defines a passage through which refrigerant from the container flows in a refrigerant flow direction; and the tube has a substantially U-shape along the refrigerant flow direction in the tube.

6. The cooling device according to claim 1, wherein:

the heat radiation fin has a plurality of radiation fin parts;

the tube has a plurality of tube parts; and the radiation fin parts and the tube parts are alternately stacked in a direction from the heat reception wall to the heat radiation wall.

7. The cooling device according to claim 1, wherein:

the heat conductor portion is constructed by at least one plate member having plural opening portions; and the plate member is disposed between the heat reception wall and the heat radiation wall.

8. The cooling device according to claim 7, wherein:

the opening portions are composed of plural first openings provided in a boiling region corresponding to an attachment position of the heat-generating member, and plural second openings provided in a peripheral region other than the boiling region; and each of the first openings is provided to be finer than that of the second openings.

9. The cooling device according to claim 1, wherein:

the tube has a tube part extending in a direction approximately perpendicular a direction from the heat reception wall to the heat radiation wall; and the tube part is inclined by a predetermined angle with respect to a wall surface of the heat reception wall.

10. The cooling device according to claim 1, wherein one of the end portions of the tube communicates with the container through a connection member having a passage sectional area larger than that of the tube.

11. The cooling device according to claim 1, wherein:

the heat-generating member is disposed on a bottom surface of the heat reception wall of the container; and the end portions of the tube are connected to the container to form two communication portions through which the tube communicates with the container, the cooling device further comprising:

a partition portion, for partitioning an upper space above a liquid refrigerant surface in the container, disposed between one of the communication portions and the heat conductor portion in a boiling region corresponding to an attachment position of the heat-generating member.

12. The cooling device according to claim 1, further comprising:

blower for blowing cooling air toward the heat radiation fin for cooling the heat radiation fin wherein;

the heat radiation fin and the tube are separated into a plurality of radiation fin parts and tube parts, respectively, in a cooling-air flowing direction.

13. The cooling device according to claim 12, further comprising:

a control plate for changing a flow direction of cooling air in the heat radiation fin, disposed at an upstream air side end of at least one tube part.

14. The cooling device according to claim 12, further comprising:

a duct, in which cooling air flows, disposed outside the tube, and the tube and the heat radiation fin are disposed in the duct to form a bypass passage through which cool air bypasses the heat radiation fin in the duct.

15. The cooling device according to claim 1, wherein:

the heat radiation fin is disposed to be cooled by cooling air flowing therethrough;

the heat radiation fin and the tube are disposed to have a first dimension in a cooling-air flowing direction in the heat radiation fin, and to have a second dimension in a refrigerant flow direction in the tube, and the heat radiation fin and the tube are inclined by a predetermined angle with respect to the cooling-air flowing direction.

16. The cooling device according to claim 1, wherein:

the heat reception wall, onto which the heat-generating member is attached, is disposed approximately vertically; and the heat radiation fin includes an upper side fin part above a liquid refrigerant surface in the container and a lower side fin part below the liquid refrigerant surface, and a fin density of the upper side fin part is lower than that of the lower side fin.

17. The cooling device according to claim 16, wherein the fin density of the upper side fin is made lower by enlarging a fin pitch thereof.

18. The cooling device according to claim 16, wherein the fin density of the upper side fin is made lower by eliminating the upper side fin in a predetermined region.

19. The cooling device according to claim 16, wherein:

the heat conductor portion is constructed by at least one plate member having plural opening portions, disposed between the heat reception wall and the heat radiation wall;

the opening portions of the plate member include first openings provided above a liquid refrigerant surface in the container, and second openings below the liquid refrigerant surface;

each of the first openings is finer than that of the second openings; and a distance between adjacent first openings is made smaller than that between adjacent second openings.

20. The cooling device according to claim 16, wherein the heat-generating member is disposed on the container below the liquid refrigerant surface.

21. The cooling device according to claim 1, wherein:

the heat-generating member is disposed on a top surface of the container; and the container has an inner volume larger than an inner volume of the tube.

22. The cooling device according to claim 21, wherein:

the heat conductor portion has a single member being continuously extended in an upper space above the liquid refrigerant surface; and the single member is only disposed in a boiling region corresponding to an attachment position of the heat-generating member.

23. The cooling device according to claim 21, wherein the heat conductor portion, disposed in a boiling region corresponding to an attachment position of the heat-generating member, is formed into a structure having a core portion and a porous material formed on a surface of the core portion.

24. The cooling device according to claim 1, wherein at least one of the end portions of the tube is opened in the container at an upper side of a liquid refrigerant surface.

25. The cooling device according to claim 1, wherein:

one end portion of the tube opens into the inner space of the container in a boiling region corresponding to an attachment portion of the heat-generating member; and the other end portion of the tube opens into the inner space of the container at a position other than the boiling region.

26. The cooling device according to claim 1, wherein:

the tube includes a first tube part and a second tube part arranged in a direction on the heat radiation wall, each of the first tube part and the second tube part having two end portions;

one end portion of the first and second tube parts opens into the inner space of the container in a boiling region corresponding to an attachment portion of the heat-generating member; and the other end portion of the first and second tube parts opens into the inner space of the container at a position other than the boiling region.

27. The cooling device according to claim 26, wherein the one end portions of the first and second tube parts are provided as a single communication end.

28. The cooling device according to claim 26, wherein:

a plurality of the first tubes and a plurality of the second tubes are arranged on the heat radiation wall in a cooling-air flowing direction, respectively; and a clearance is defined between adjacent first and second tubes in a direction crossing the cooling-air flowing direction.

29. The cooling device according to claim 25, wherein the heat-generating member is disposed on the heat reception wall substantially at a center portion in a direction crossing a cooling-air flowing direction.

30. The cooling device according to claim 1, wherein:

the heat radiation wall has two insertion holes; and the two end portions of the tube are inserted into the insertion holes to communicate with the inner space of the container.

31. The cooling device according to claim 1, wherein:

the tube has first and second tube parts having the two end portions respectively, and a third tube part connecting the first and second tube parts, and at least one of the first and second tube parts extends substantially vertically with respect to the heat radiation wall.

32. The cooling device according to claim 31, wherein:

at least one of the first and second tube parts has a length that is shorter than a length of the third tube part.

33. The cooling device according to claim 1, wherein the heat radiation fin is a corrugated fin.

34. The cooling device according to claim 33, wherein the corrugated fin has a wave shape that extends in an extending direction of the heat radiation wall.

35. The cooling device according to claim 1, wherein one end portion of the tube communicates with the container at a position proximate to the heat-generating member, and the other end portion of the tube communicates with the container at a portion distal from the heat-generating member.

36. The cooling device according to claim 35, wherein the heat-generating member is attached to the heat reception wall in an approximate center area of the heat reception wall.

37. The cooling device according to claim 1, wherein:

the heat reception wall and the heat radiation wall extend in an extension direction approximately in parallel with each other;

one end portion of the tube is opened in the heat radiation wall at a center area in the extending direction; and the other end portion of the tube is opened in the heat radiation wall at an end side in the extending direction.

38. The cooling device according to claim 37, wherein:

the tube is constructed of a first tube part having the one end portion, a second tube part having the other end portion, and a third tube part connecting the first tube part and the second tube part;

the first tube part is provided to be approximately vertical to the heat radiation wall.

39. The cooling device according to claim 38, wherein the second tube part is provided to be approximately vertical to the heat radiation wall.

40. The cooling device according to claim 1, wherein:

the heat reception wall has a first surface area corresponding to an attachment area of the heat-generating member, and a second surface area other than the first surface area;

the heat radiation wall has a first surface area opposite to the first surface area of the heat reception wall, and a second surface area opposite to the second surface area of the heat reception wall;

one end portion of the tube is opened in the first surface area of the heat radiation wall; and the other end portion of the tube is opened in the second surface area of the heat radiation wall.

41. The cooling device according to claim 1, wherein:

the tube includes a first tube part and a second tube part that are arranged in an extension direction of the heat radiation wall;

the heat radiation wall has a first surface area corresponding to an attachment area of the heat-generating member, and a second surface area other than the first surface area;

each one end portion of the first and second tube parts is opened in the first surface area of the heat radiation wall; and each the other end portion of the first and second tube parts is opened in the second surface area of the heat radiation wall.

42. The cooling device according to claim 1, wherein the each of the heat reception wall and the heat radiation wall has a surface area that is larger than an attachment area of the heat-generating member.

* * * * *